US007836908B2

(12) United States Patent
Sy-Facunda

(10) Patent No.: US 7,836,908 B2
(45) Date of Patent: Nov. 23, 2010

(54) CANOPY WITH AUTOMATIC ROOF STRUCTURE HAVING IMPROVED STRUCTURAL STABILITY

(75) Inventor: Ron Sy-Facunda, Thousand Oaks, CA (US)

(73) Assignee: Bravo Sports, Santa Fe Springs, CA (US)

( * ) Notice: Subject to any disclaimer, the term of this patent is extended or adjusted under 35 U.S.C. 154(b) by 0 days.

(21) Appl. No.: 11/851,156

(22) Filed: Sep. 6, 2007

(65) Prior Publication Data

US 2008/0066795 A1 Mar. 20, 2008

Related U.S. Application Data

(60) Provisional application No. 60/825,981, filed on Sep. 18, 2006.

(51) Int. Cl.
*E04H 15/50* (2006.01)
*E04H 15/46* (2006.01)

(52) U.S. Cl. ..... 135/145; 135/147; 135/122; 135/131

(58) Field of Classification Search ..... 135/87, 135/121, 122, 128, 129, 130, 131, 135, 140, 135/143, 144, 145, 146, 147, 157, 158, 159, 135/160; 52/63, 83
See application file for complete search history.

(56) References Cited

U.S. PATENT DOCUMENTS 4,558,713 A * 12/1985 Hagler et al. ..... 135/159
4,607,656 A 8/1986 Carter
4,641,676 A 2/1987 Lynch
4,779,635 A 10/1988 Lynch
4,885,891 A 12/1989 Lynch
4,924,896 A 5/1990 Carter
4,947,884 A 8/1990 Lynch
D316,288 S 4/1991 Lynch
5,187,843 A 2/1993 Lynch
5,226,440 A * 7/1993 Fuhrman ..... 135/159
5,234,011 A 8/1993 Lynch
5,244,001 A 9/1993 Lynch
5,421,356 A 6/1995 Lynch
5,485,863 A 1/1996 Carter
5,490,533 A 2/1996 Carter
5,511,572 A 4/1996 Carter
5,632,292 A 5/1997 Carter
5,632,293 A 5/1997 Carter (Continued)

FOREIGN PATENT DOCUMENTS

AU 2002247358 5/2003

(Continued)

*Primary Examiner*—David Dunn
*Assistant Examiner*—Danielle Jackson
(74) *Attorney, Agent, or Firm*—Holland & Hart LLP

(57) ABSTRACT

The technology of the present application provides a canopy with an automatic roof structure having improved structural stability. The canopy comprises a plurality of vertical support posts connected by trusses. A plurality of roof support rods extend from the vertical support posts to a central hub. At least one of the roof support rods has a cantilever support extending from the associated slide or thereabouts to a pivot on the roof support rod. The canopy also comprises central truss supports and stubs extending from the connection of the lateral trusses to the central hub. The canopy has an expanded, open configuration and a collapsed, closed configuration.

18 Claims, 5 Drawing Sheets

U.S. PATENT DOCUMENTS 5,634,483 A * 6/1997 Gwin ..... 135/131
5,794,640 A 8/1998 Jang
5,797,412 A 8/1998 Carter
5,813,425 A 9/1998 Carter
5,918,614 A 7/1999 Lynch
5,921,260 A 7/1999 Carter
5,934,301 A 8/1999 Carter
5,944,040 A * 8/1999 Jang ..... 135/126
6,041,800 A 3/2000 Carter
6,070,604 A 6/2000 Carter
6,076,312 A 6/2000 Carter
6,129,102 A 10/2000 Carter
6,138,702 A 10/2000 Carter
6,152,157 A 11/2000 Jang
6,192,910 B1 2/2001 Carter
6,206,020 B1 3/2001 Lynch
6,219,888 B1 4/2001 Lynch
6,230,729 B1 5/2001 Carter
6,240,940 B1 6/2001 Carter
6,361,057 B1 3/2002 Carter
6,363,956 B2 4/2002 Carter
6,374,842 B1 4/2002 Carter
6,382,224 B1 5/2002 Carter
6,397,872 B1 6/2002 Carter
6,412,507 B1 7/2002 Carter
6,431,193 B2 8/2002 Carter
6,439,251 B2 8/2002 Carter
6,470,902 B1 * 10/2002 Carter ..... 135/145
6,478,039 B2 11/2002 Suh
6,502,597 B2 1/2003 Carter
6,520,196 B2 2/2003 Carter
6,575,656 B2 6/2003 Suh
6,601,599 B2 8/2003 Carter
6,701,949 B2 3/2004 Carter
6,708,707 B2 * 3/2004 Dotterweich et al. ..... 135/131
6,712,083 B2 3/2004 Carter
6,725,873 B2 * 4/2004 Liu ..... 135/145
6,748,963 B2 6/2004 Carter
6,796,320 B2 9/2004 Carter
6,868,858 B2 3/2005 Suh
6,874,519 B2 * 4/2005 Chiang ..... 135/131
6,874,520 B2 4/2005 Carter
6,920,889 B2 7/2005 Carter
6,923,195 B2 * 8/2005 Tseng ..... 135/122
6,926,021 B2 8/2005 Carter
6,981,510 B2 1/2006 Carter
7,025,075 B2 4/2006 Suh
7,051,745 B2 5/2006 Carter
7,178,541 B2 2/2007 Carter
7,178,542 B2 2/2007 Carter
7,207,344 B2 4/2007 Wu
7,240,685 B2 7/2007 Seo
7,240,686 B2 7/2007 Seo
7,240,687 B2 7/2007 Carter
7,252,108 B2 8/2007 Carter
7,299,812 B2 11/2007 Carter
7,308,901 B2 12/2007 Meyer
7,311,112 B2 12/2007 Pacheco
7,360,549 B2 4/2008 Seo
7,380,563 B2 6/2008 Seo
7,395,830 B2 7/2008 Seo
7,428,908 B2 9/2008 Seo
RE40,544 E 10/2008 Suh
RE40,657 E 3/2009 Suh
2003/0037812 A1 * 2/2003 Stewart et al. ..... 135/96
2004/0020526 A1 * 2/2004 Deng ..... 135/131
2004/0084074 A1 * 5/2004 Chiu et al. ..... 135/131
2004/0250847 A1 * 12/2004 Chiang ..... 135/131
2005/0155637 A1 * 7/2005 Kim ..... 135/131
2006/0096631 A1 * 5/2006 Mallookis et al. ..... 135/131
2006/0174928 A1 * 8/2006 Choi ..... 135/145
2006/0174929 A1 * 8/2006 Tseng ..... 135/159

FOREIGN PATENT DOCUMENTS

AU 2004203308 2/2005
CA 2447952 11/2002
CA 2475232 2/2005
CA 2455021 4/2007
CA 2441567 6/2007
GB 2398346 4/2005
GB 2392459 11/2005
GB 2404932 11/2005
GB 2406107 11/2005
GB 2410041 11/2005
GB 2410962 10/2008
GB 2472418 4/2009

* cited by examiner

CANOPY WITH AUTOMATIC ROOF STRUCTURE HAVING IMPROVED STRUCTURAL STABILITY

PRIORITY INFORMATION

Under 35 U.S.C. §119(e), the present application claims priority to U.S. Provisional Patent Application Ser. No. 60/825,981, filed Sep. 18, 2006, titled CANOPY WITH AUTOMATIC ROOF STRUCTURE HAVING IMPROVED STRUCTURAL STABILITY.

STATEMENT REGARDING FEDERALLY SPONSORED RESEARCH

None.

CROSS-REFERENCE TO RELATED APPLICATIONS

None.

FIELD OF THE INVENTION

The present invention relates to a canopy structure and, more particularly, to a canopy structure with an automatic roof structure having improved structural stability.

BACKGROUND OF THE INVENTION

Canopies and other outdoor shade structures have been in existence through history. However, with the advent of improved mechanics and materials, a need has developed to provide canopies with more height, increased head room, lighter weight, easier to use, and increased portability.

U.S. Pat. No. 4,607,656, issued on Aug. 26, 1986, to Carter (expired), incorporated herein by reference, discloses an early collapsible canopy that was easier to use and required reduced room to store. The '656 patent specifically relates to a canopy that comprises a plurality of vertical legs connected by X shaped trusses. The X shaped trusses have a bottom portion slidably connected to the vertical legs allowing the plurality of vertical legs to be moved from a closed, stored position to an open, erect position without a complex connection between the various legs. U.S. Pat. No. 4,641,676, issued on Feb. 10, 1987, to Lynch (expired), incorporated herein by reference, discloses a similar canopy structure.

While the structures disclosed by the '656 and '676 patents provided improvement over then available portable canopies, which required complex construction and breakdown to use, both the '656 and '676 patents used X shaped trusses extending across the middle of the canopy to provide a support for a top cover. The horizontal X shaped truss extending across the middle of the canopy provided drawbacks, including, for example, the canopy had relatively low clearance. Many improvements have been derived from the original patents relating to canopies having X shaped trusses in an attempt to increase the head clearance of canopies. One particularly elegant design is highlighted by U.S. Pat. No. 4,779,635, issued Oct. 25, 1988, to Lynch. The '635 patent is similar to the above described designs, but provides a roof support member connected to at least one of the vertical legs with a cantilever support. Thus, the canopy still is collapsible into a compact unit for moving and storage, but when extended, the roof members automatically expands above the X shaped trusses. The cantilever provides a mechanism to automatically push the roof members from a folded or retracted position into an unfolded or extended position.

While the automatic roof structure of the '635 patent greatly increased headroom and enhanced the easy of operation of the portable device, the higher, angled roof structure tended to decrease the overall structure's stability and strength. Thus, it would be desirous to develop a canopy with an automatic roof structure that has improved structural stability and strength.

SUMMARY OF THE INVENTION

The technology of the present application provides a canopy with an automatic roof structure having improved structural stability. The canopy comprises a plurality of vertical support posts connected by trusses. A plurality of roof support rods extend from the vertical support posts to a central hub. At least one of the roof support rods has a cantilever support extending from the associated slide or thereabouts to a pivot on the roof support rod. The canopy also comprises central truss supports and stubs extending from the connection of the lateral trusses to the central hub. The canopy has an expanded, open configuration and a collapsed, closed configuration.

The foregoing and other features, utilities and advantages of the invention will be apparent from the following more particular description of a preferred embodiment of the invention as illustrated in the accompanying drawings

BRIEF DESCRIPTION OF THE DRAWINGS

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Referring now to FIGS. 1-5B, the technology of the present application will now be explained. One of ordinary skill in the art will recognize that the present technology is explained with reference to a portable, instant canopy structure, but the technology could be used in other structures, such as, for example, tents, vehicle ports, or the like.

Figure 1:
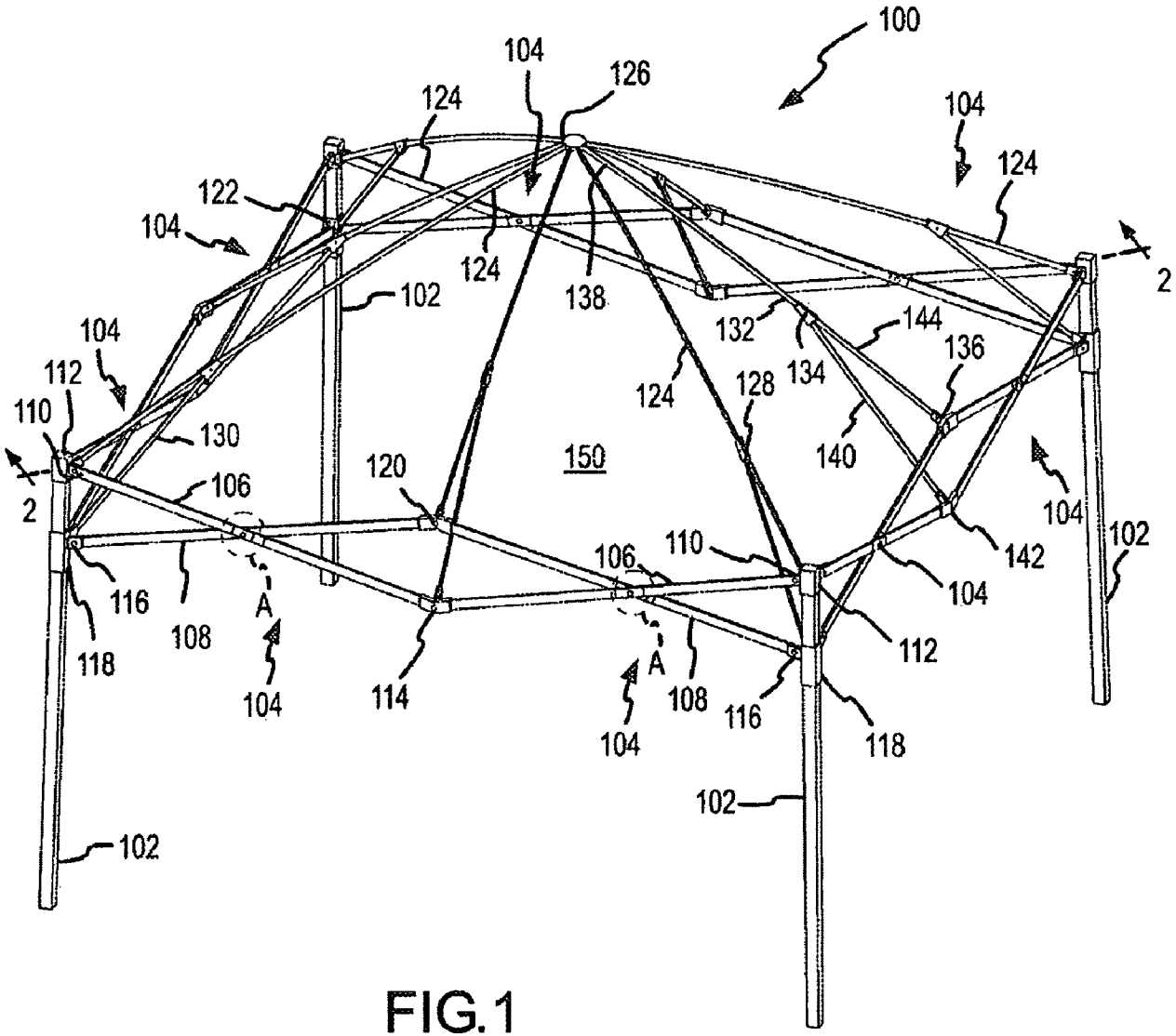
FIG. 1 is a perspective view of a canopy constructed in accordance with the disclosure.

With reference to FIG. 1, a perspective view of a canopy 100 is shown. Only the roof section of canopy 100 is shown in detail for convenience. Canopy 100 includes a plurality of vertical corner support posts 102. Vertical corner support posts 102 may be slightly canted for stability. Moreover, posts 102 may be extendible from a retracted, storage position to an extended, use position as is generally known in the art and not further described or shown for convenience. Connecting adjacent pairs of vertical corner support posts 102 are expandable and collapsible trusses 104. While two sets of expandable and collapsible trusses 104 are shown connecting adjacent pairs of vertical corner support posts 102, more or less are possible as a function of canopy size. In some designs, it may be beneficial to place a vertical wall support post, which would be substantially similar to vertical corner support posts 102 and is not separately shown or described. As shown, each truss 104 comprises a first member 106 pivotally connected to a second member 108 at pivot point A where first member 106 and second member 108 cross. First member 106 has a first end 110 connected to a top 112 of associated vertical corner support post 102 and a second end 114 connected to the second end 114 of another first member 106. Second member 108 has a third end 116 connected to a sliding member 118 on associated vertical corner support post 102 and second member 108 has a fourth end 120 connected to fourth end 120 of an associated second member 108. First end 110 and third end 116 are sometimes referred to as the outer ends of the trusses and second end 114 and fourth end 120 are sometimes referred to as the inner ends of the trusses. The above described expandable and collapsible trusses 104 are sometimes referred to as an XX-truss, double X truss, eaves, or scissor assembly. However, one of ordinary skill in the art would understand on reading this disclosure that an actual X shape is not necessary and other expandable and collapsible truss systems are possible, such as, for example, U.S. Pat. No. 5,701,923, issued to Losi et al., on Dec. 30, 1997, and incorporated herein by reference as if set out in full.

Slider member 118 moves along vertical corner support post 102 from a collapsed position to an expanded position. When in the expanded position, slider member is held in place on vertical corner support post 102 using any of a number of conventional retention devices 122, such as, for example, a pin and detent or the like.

As shown in FIG. 1, canopy 100 further includes an automatically deploying roof support structure. Roof support structure includes a plurality of roof support rods 124 extending from top 112 of a corresponding vertical corner support member 102 to a central hub 126. Central hub is shown as a simple connection in FIG. 1 for convenience, but details of a possible central hub are provided in FIG. 5. As shown, roof support rod 124 folds about hinge 128 to allow roof support rod 124 to fold and unfold into the collapsed and expanded positions. As explained in the '635 patent, roof support rods 124 may be designed as telescopic members as a matter of design choice. A plurality of cantilever support arms 130 extend from slider member 118 to roof support rods 124. Cantilever support arm 130 tends to force roof support rod 124 from the folded to the unfolded position as slider member 118 moves from the collapsed position to the expanded position. Once opened and locked in place, slider member 118 and cantilever support arm 130 tends to hold roof support rod 124 in the open, expanded configuration. Notice, cantilever support arm does not need to be directly connected to slider member 118, but could be connected to the trusses instead, for example.

Canopy 100 also comprises a central truss support 132. Central truss support 132 comprises an angled first center member 134 having a first end 136 connected to second ends 120 and a second end 138 connected to hub 128. Central truss supports 132 also comprises stubs 140 (sometimes referred to as a cantilever, second center member or center member support) having first ends 142 connected to second ends 114 and second end 144 connected to the body of first center member 134. Roof support rods 124, central truss supports 132, and hub 126 connections are explained in more detail in FIGS. 5A and 5B, below. As one of ordinary skill in the art would recognize on reading this disclosure, the above connections generally relate to pivotal connections. Pivotal connections for instant canopies are well known in the art and generally not further explained herein.

As can be appreciated on reading the disclosure, the central truss support 132 provides increased structural support against lateral forces on the middle of the expandable, collapsible trusses 104 (sometimes referred to as eaves in the art). Moreover, the roof support rods 124 in combination with the central truss support 132 provide increased support for the shell draped over canopy 100 (not shown in FIG. 1), sometimes referred to as the canopy cover. Additionally, using roof support rods 124 in combination with central truss support 132 provides more horizontal support for the shell to decreasing the droop of the shell providing a aesthetically pleasing look. Finally, because central truss support 132 comprises an angled first center member 134 and a stub 140, the headroom under the shell is not compromised toward a center 150 of the canopy area.

Figure 2:
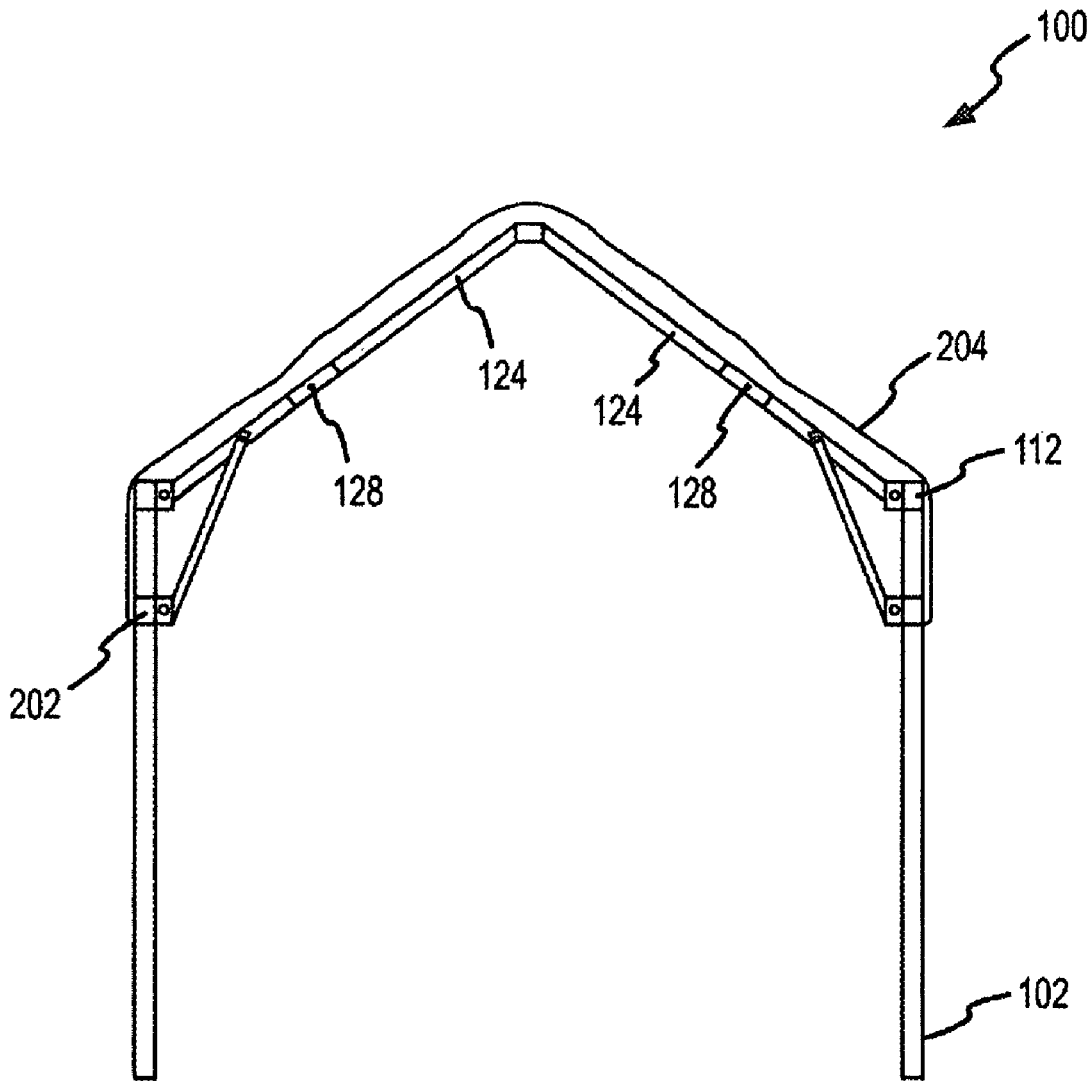
FIG. 2 is an elevation view of roof support rods from the canopy of FIG. 1.
Figure 3:
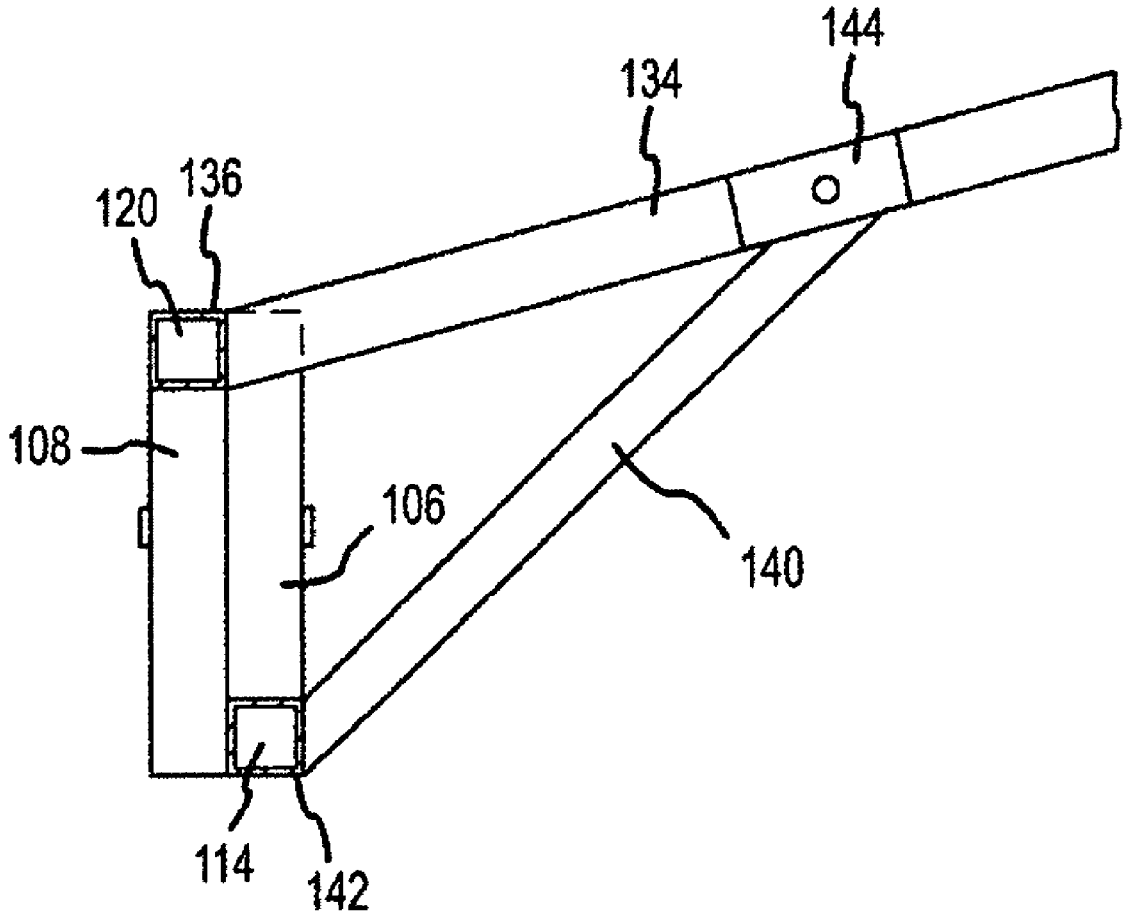
FIG. 3 is an elevation view of the central truss support FIG. 1 connected to expandable and collapsible trusses.
Figure 4:
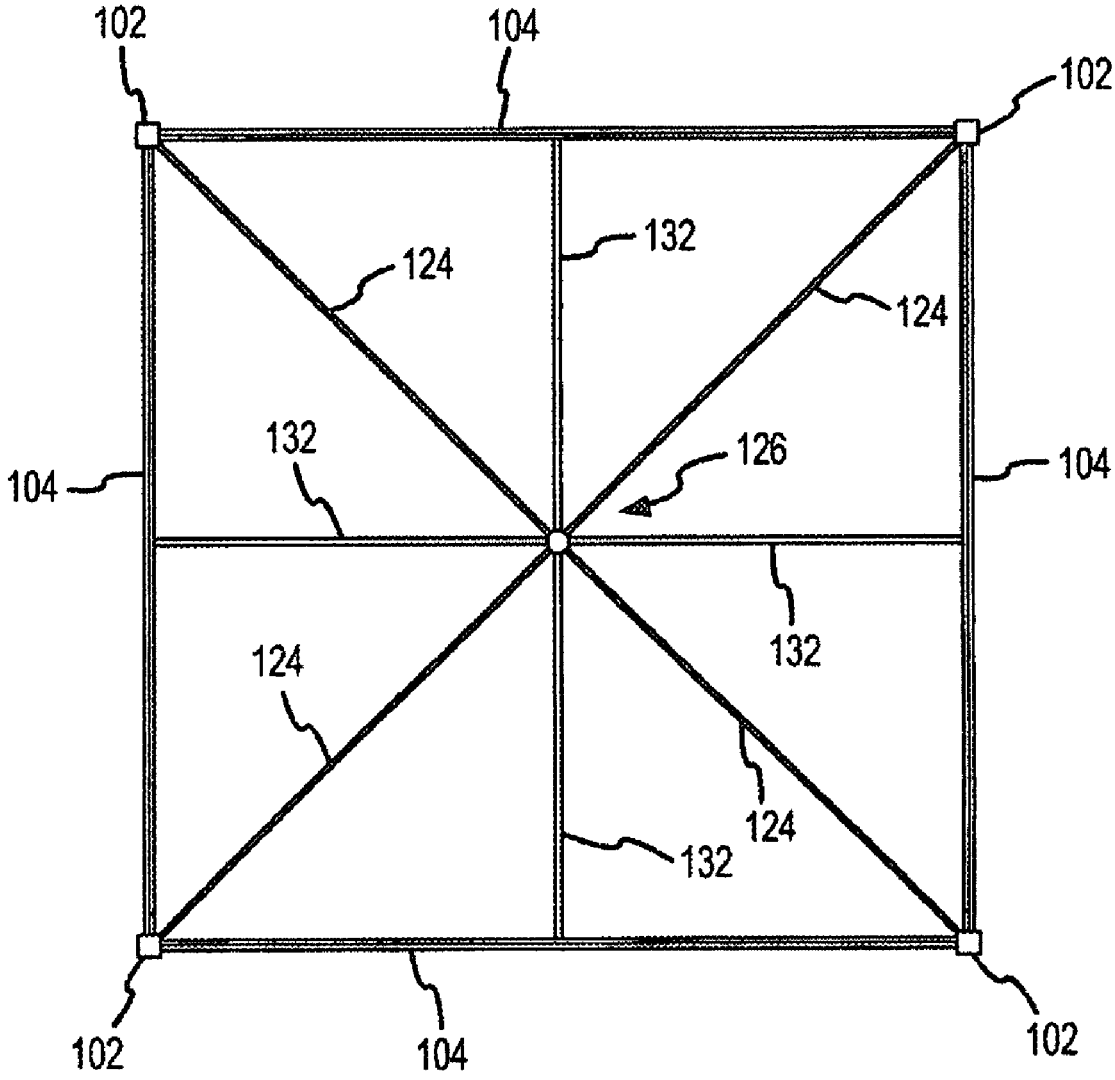
FIG. 4 is a top plane view of the canopy of FIG. 1.

Referring now to FIG. 2, a cross-section of canopy 100 is provided along line 2-2 of FIG. 1. Cross-section 2-2 is taken along the diagonal of canopy 100. As better shown in FIG. 2, roof support rods 124 are pivotally connected to tops 112 of vertical corner support posts 102 and pivotally connected to hub 126. Further, roof support rods 124 fold about hinges 128 to allow roof support rods 124 to be arranged in both the expanded state as shown and a collapsed state as is generally known in the art. Slider member 118 slidably connects to vertical corner support post 102 and may be locked in the expanded position (shown) using a button latch 202. Cantilever support arms 130 pivotally connect to slider member 118 and pivotally connect to roof support rod 124, which may coincide with hinges 128. Cantilever support arms may be detachable from roof support rods 124 as a matter of design choice. Also shown in FIG. 2 is a shell or canopy cover 204 draped over canopy frame 100. While shown in a loose fitting configuration, shell 204 may be drawn taut.

Figure 5A:
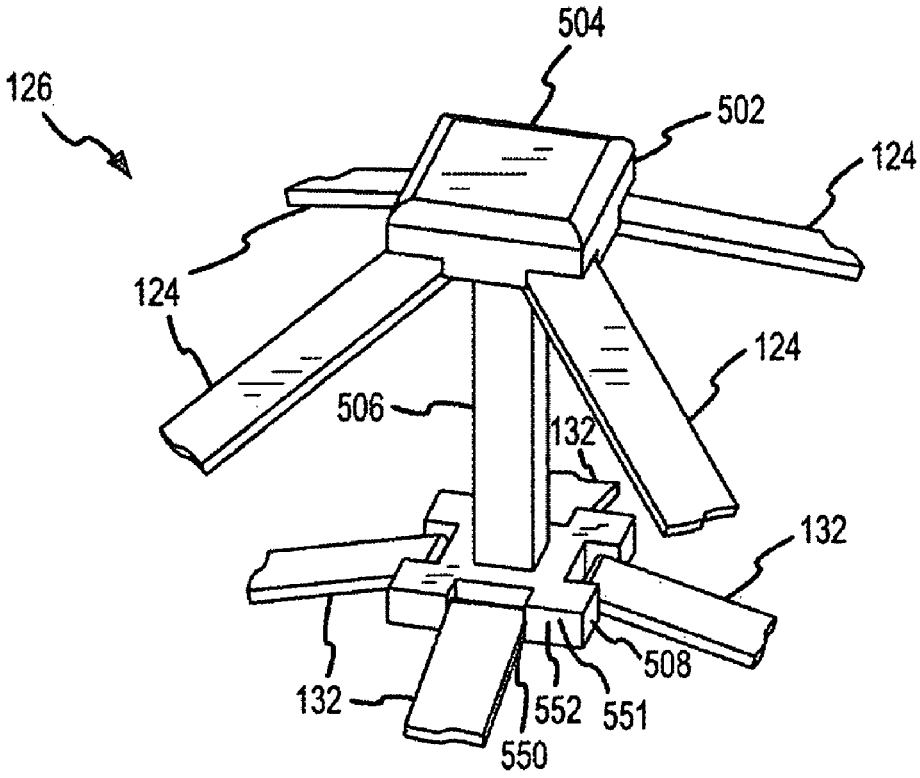
FIGS. 5A and 5B are a detail of the central hub including central truss supports and roof support rods.
Figure 5B:
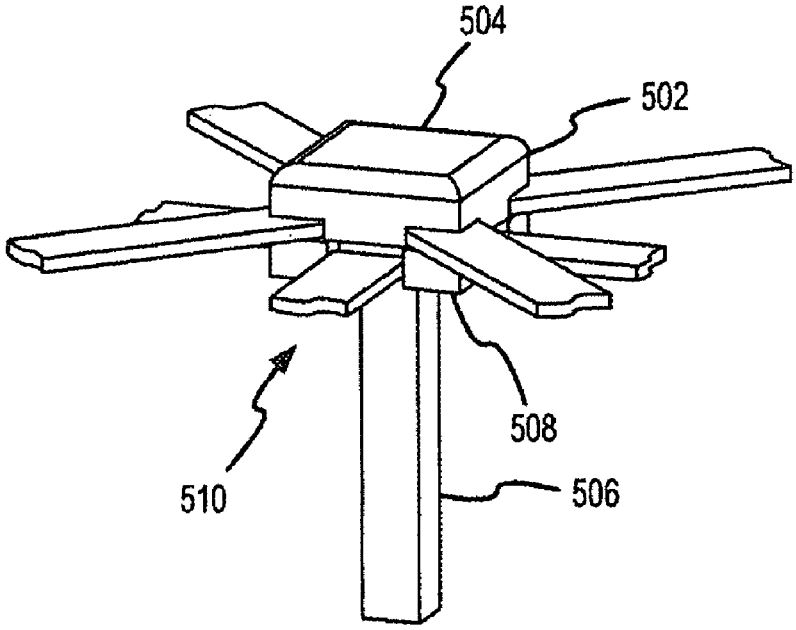

Referring now to FIGS. 5A and 5B, central hub 126 is shown in more detail. FIG. 5A shows central hub 126 in the erect or expanded state and FIG. 5B shows central hub 126 in the collapsed state. Central hub 126 comprises a roof support rod connection 502, which is shown as having a dome top 504 to press against the shell. Roof support rod connection 502 is pivotally coupled to each roof support rod 124. A vertical roof support post 506 extends opposite dome top 504 to a central truss support connection 508. Central truss support connection 508 is pivotally connected to each central truss support 132. The pivotal connections are generally as known in the art and will not be explained herein. Central truss support connection 508 has a bore 510. In the erect state, roof support rod connection 502 and central truss support connection 508 are spaced apart a distance D. In the collapsed state, roof support rod connection 502 is collapsed toward central truss support 508 and vertical roof support post 506 moves through bore 510 and resides below central truss support connection 508. Roof support rods 124 and central truss support 132 is not labeled in FIG. 5B for convenience.

The roof support rods and central truss rods may be connected to the central hub using any number of pivotal connections as is generally known in the art. For example, a flanged part 550 may have two panels 551. One panel 551 is pivotally connected to central truss support connection 508 using a pin 552 or the like. The other panel 551 is pivotally connected to central truss support 132 using a pin 552 or the like.

The previous description of the disclosed embodiment is provided to enable any person skilled in the art to make or use the technology of the present application. Various modifications to the embodiment will be readily apparent to those skilled in the art on reading the disclosure, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A collapsible canopy, comprising:

a canopy cover; and a canopy frame to support the canopy cover, the canopy frame comprising:

a plurality of vertical corner support posts;

a plurality of trusses linking each pair of the plurality of vertical corner support posts, each of the plurality of trusses having an expanded position and a collapsed position, comprising:

a first member having a first fixed end fixedly coupled to one of the plurality of upwardly extending poles and a second end coupled to the second end of another first member;

a second member having a third movable end slidably coupled to one of the plurality of upwardly extending poles and a fourth end coupled to the fourth end of another second member;

a central hub, comprising:

a roof support connection, a central truss support connection, and a vertical post, and the roof support connection fixedly connected to the vertical post and the central truss support connection slidably coupled to the vertical post such that the roof support connection and the central truss support connection are movable toward each other from an expanded position to a collapsed position;

a plurality of roof support rods, each of the plurality of roof support rods comprising a first end pivotally coupled to a top of one of the vertical corner support posts and a second end pivotally coupled to the roof support connection such that the central hub is above a plane defined by the tops of the plurality of vertical corner support posts in the expanded position, each of the plurality of roof support rods having an expanded position and a collapsed position; and a plurality of central truss supports, each of the plurality of central truss supports being pivotally connected directly to one of the plurality of trusses at a first end and a second end pivotally coupled to the central truss support connection.

2. The collapsible canopy of claim 1, wherein each of the plurality of roof support rods comprises a hinge to allow the roof support rod to fold between the collapsed position and the extended position.

3. The collapsible canopy of claim 1, further comprising at least one cantilever support arm, the at least one cantilever support arm pivotally coupled to at least one roof support rod and pivotally and slidably coupled to at least one of the vertical corner support posts.

4. The collapsible canopy of claim 3, wherein the at least one cantilever comprises a plurality of cantilevers that corresponds to the plurality of roof support rods.

5. The collapsible canopy of claim 1, wherein the plurality of vertical corner support post are canted.

6. The collapsible canopy of claim 1, wherein the vertical roof support post is slidably coupled to a bore in the central truss support connection.

7. The collapsible canopy of claim 1, wherein each of said plurality of central truss supports is pivotally coupled to a respective one of said plurality of trusses at a point proximate the fourth end of the second member and the fourth end of the another second member.

8. The collapsible canopy of claim 7, wherein each of said plurality of central truss supports comprises a hinge wherein each of the central truss supports has an extended position and a collapsed position.

9. The collapsible canopy of claim 7, wherein each of said plurality of central truss supports further comprises a stub pivotally coupled thereto and pivotally coupled at a point proximate the second end of the first member and the second end of the another first member.

10. The collapsible canopy of claim 1, wherein the roof support connection and the central truss support connection are in contact with each other when the central hub is in the collapsed position, and spaced apart when the central hub is in the expanded position.

11. The collapsible canopy of claim 10, wherein the central hub is in the collapsed position when the plurality of trusses are each in the collapsed position.

12. A collapsible canopy with a roof support assembly, the canopy frame having a plurality of vertical corner support posts and a plurality of trusses linking each pair of the plurality of vertical corner support posts, each of the plurality of trusses having an expanded position and a collapsed position with a first member having a first fixed end fixedly coupled to one of the plurality of upwardly extending poles and a second end coupled to the second end of another first member and a second member having a third movable end slidably coupled to one of the plurality of upwardly extending poles and a fourth end coupled to the fourth end of another second member, the roof support assembly comprising:

a plurality of roof support rods, each of the plurality of roof support rods comprising a first end pivotally coupled to a top of one of the vertical corner support posts, each of the plurality of roof support rods having an expanded position and a collapsed position; and a plurality of central truss supports, each of the plurality of central truss supports being pivotally connected to one of the plurality of trusses at a first end; and a central hub, the central hub comprising a roof support connection to which the plurality of roof support rods are pivotally coupled such that the central hub is above a plane defined by the tops of the plurality of vertical corner support posts in an expanded position, a central truss support connection to which a second end of each of the plurality of central truss supports are pivotally coupled, and a vertical roof support post coupling the roof support connection and the central truss support connection, the vertical roof support post slidably coupled to the central truss support connection such that the roof support connection and the central truss support connection are movable toward each other from an expanded position to a collapsed position, and wherein the central hub is in the collapsed position when the plurality of trusses are each in the collapsed position.

13. The collapsible canopy with a roof support assembly of claim 12, wherein the roof support connection and the central truss support connection are in contact with each other when the central hub is in the collapsed position, and spaced apart when the central hub is in the expanded position.

14. The collapsible canopy with a roof support assembly of claim 13, wherein each of said plurality of central truss supports is pivotally coupled to a respective one of said plurality of trusses at a point proximate the fourth end of the second member and the fourth end of the another second member and wherein each of said plurality of central truss supports further comprises a stub pivotally coupled thereto and pivotally coupled at a point proximate the second end of the first member and the second end of the another first member.

15. A collapsible canopy, comprising:

a canopy cover; and a canopy frame to support the canopy cover, the canopy frame comprising:

a plurality of vertical corner support posts;

a plurality of trusses linking each pair of the plurality of vertical corner support posts, each of the plurality of trusses having an expanded position and a collapsed position, comprising:

a first member having a first fixed end fixedly coupled to one of the plurality of upwardly extending poles and a second end coupled to the second end of another first member;

a second member having a third movable end slidably coupled to one of the plurality of upwardly extending poles and a fourth end coupled to the fourth end of another second member;

a central hub, comprising:

a roof support connection, a central truss support connection, and a vertical post, and the roof support connection fixedly coupled to the vertical post and the central truss support connection slidably coupled to the vertical post such that the roof support connection and the central truss support connection are movable toward each other from an expanded position to a collapsed position;

a plurality of roof support rods, each of the plurality of roof support rods comprising a first end pivotally coupled to a top of one of the vertical corner support posts and a second end pivotally coupled to the roof support connection such that the central hub is above a plane defined by the tops of the plurality of vertical corner support posts when in an expanded position, each of the plurality of roof support rods having an expanded position and a collapsed position; and means for providing increased lateral support for the roof pivotally coupled directly to one of the plurality of trusses at a first end and pivotally coupled to the central truss support connection at a second end.

16. The collapsible canopy of claim 15, wherein the means for providing increased lateral support for the roof comprises a plurality of central truss supports, each of the plurality of central truss supports being pivotally connected to one of the plurality of trusses at the first end and pivotally coupled to the central hub at the second end and a stub pivotally coupled to the central truss support and pivotally coupled at a point proximate the second end of the first member and the second end of the another first member.

17. The collapsible canopy of claim 16, wherein the roof support connection and the central truss support connection are in contact with each other when the central hub is in the collapsed position, and spaced apart when the central hub is in the expanded position.

18. The collapsible canopy of claim 17, wherein the central hub is in the collapsed position when the plurality of trusses are each in the collapsed position.

* * * * *